US005257792A

United States Patent [19]

Putch et al.

[11] Patent Number: 5,257,792

[45] Date of Patent: Nov. 2, 1993

[54] WELL HEAD METAL SEAL

[75] Inventors: Samuel W. Putch, Houston; Jack K. Sarver, Humble; John W. Pierce, Spring, all of Tex.

[73] Assignee: Fip Incorporated, Houston, Tex.

[21] Appl. No.: 866,717

[22] Filed: Apr. 10, 1992

Related U.S. Application Data

[63] Continuation-in-part of Ser. No. 776,918, Oct. 15, 1991, abandoned.

[51] Int. Cl.[5] ..... F16J 15/00; E21B 19/10

[52] U.S. Cl. ..... 277/236; 277/112; 277/115; 277/117; 285/140; 166/387

[58] Field of Search ..... 277/236, 190, 112, 115, 277/117-122, 123-125, 59, 116.6, 105, 116.2; 166/82, 84, 85, 88, 89, 208, 217, 387; 285/138-148, 339, 340, 137.2, 332.2

[56] References Cited

U.S. PATENT DOCUMENTS

| | | | |
|---|---|---|---|
| 196,220 | 10/1877 | Gordon et al. | 277/116.6 |
| 1,755,436 | 4/1930 | Fandi | 277/115 |
| 2,477,969 | 8/1949 | Donner | 277/112 |
| 2,508,286 | 5/1950 | Otis | 277/116.6 X |
| 2,639,169 | 5/1953 | Jones | 285/140 |
| 3,150,889 | 9/1964 | Watts | 277/115 X |
| 3,166,345 | 1/1965 | Pinkard | 285/137.2 X |
| 3,218,087 | 11/1965 | Hallesy | 277/112 |
| 3,311,168 | 3/1967 | Pierce, Jr. | 285/140 X |
| 3,494,638 | 2/1970 | Todd et al. | 285/143 X |
| 3,797,864 | 3/1974 | Hynes et al. | 285/140 |
| 4,056,272 | 11/1977 | Morrill | 285/140 |
| 4,390,186 | 6/1983 | McGee et al. | 277/236 |
| 4,455,040 | 6/1984 | Shinn | 285/142 |
| 4,469,172 | 9/1984 | Clark | 166/115 |
| 4,515,400 | 5/1985 | Smith et al. | 285/142 X |
| 4,601,498 | 7/1986 | Hangen | 277/236 X |
| 4,652,022 | 3/1987 | Nichols | 285/140 X |
| 4,771,832 | 9/1988 | Bridges | 166/82 X |
| 4,911,245 | 3/1990 | Adamek et al. | 166/84 X |

FOREIGN PATENT DOCUMENTS

| | | | |
|---|---|---|---|
| 993505 | 11/1951 | France | 277/59 |
| 3754 | of 1902 | United Kingdom | 277/120 |

*Primary Examiner*—William A. Cuchlinski, Jr.
*Assistant Examiner*—Daniel G. DePumpo
*Attorney, Agent, or Firm*—Fulbright & Jaworski

[57] ABSTRACT

A metal well head seal for sealing between inner and outer concentric well head components which includes a circular metal seal having a flat end and a tapered end and positioned between the inner and outer components. A forcing cone on one of the components engages the tapered end for sealing, a backup shoulder engages the flat end as the inner and outer components are longitudinally moved together for setting the metal seal. An adjusting nut adjusts the tolerances between the tapered end and the forcing cone.

5 Claims, 3 Drawing Sheets

WELL HEAD METAL SEAL

CROSS-REFERENCE TO RELATED APPLICATION

This application is a continuation-in-part of application Ser. No. 07/776,918, filed Oct. 15, 1991, entitled "Well Head Metal Seal", now abandoned.

BACKGROUND OF THE INVENTION

The present invention is directed to metal seals for use in a well head such as between the head and the casing, between the hanger assembly and the head, and between the hanger assembly and the tubing head adapter.

Resilient seals are presenting a problem in well heads, especially, in high temperature gas service and other environments such as high H2S and CO2 content mixed with high temperature and pressure. The industry has been asking for tubing head metal seals and more recently casing metal seals. The present metal seals have many problems. A partial list of these problems are high cost, close tolerance, fine finishes, tolerance accumulation, one-directional seal, problems holding gas, seals can be used only once, need multiple seals or shims, not enough energy to effect the metal seal, etc.

The present invention is an economical, bidirectional seal that is very reliable and will hold high or low pressure gas as well as liquids. The seal ring requires neither close tolerances nor fine finishes and it incorporates a tolerance adjustor so that only one size seal is needed. The seal can be used more than one time if needed in the field and if there is a leak, the seal can be effected by manipulation of the tolerance adjustor to effect more squeeze, thus requiring no outside help or additional parts to make a seal.

The present invention is also directed to providing means for preventing the well casing from expanding in a longitudinal direction and breaking the integrity of the casing metal seal and other seals and/or unseating the casing hanger.

And in addition, the present invention is directed to providing a fire resistant well head by providing a well head system with all metal seals.

SUMMARY OF THE INVENTION

An objective of the present invention is the provision of a metal seal to make a single seal ring that will seal on a straight bore in a tubing head. The seal ring is protected until formed into its sealing shape when energized to hold high temperature and high and low pressure gas or liquid in two directions. When formed, the seal ring is compressed so that it coins and forms a seal at a predetermined place and also generates spring forces which keep it energized (an interference fit) if load is removed for any reason.

Another objective is the provision of a casing metal seal to make a single seal that will seal on the O.D. of raw casing in a casing spool and a casing or tubing head. The seal is protected until formed into a sealing shape when energized to hold high temperature and high or low pressure gas or liquid in two directions. When formed, the seal is in compression so that it coins and forms a seal at a predetermined place and also generates spring forces which keep it energized (an interference fit) if load is removed.

Other objectives are to provide well head seals so that tolerances can be controlled, the seal ring could be used more than once if needed in the field and to have enough force to adequately actuate the seal. This is accomplished by incorporating a tolerance adjustor and using the energy stored in the flange studs to actuate the metal seal. The tolerance adjustor is a nut that has a flat bearing surface on the top so that it can be adjusted a predetermined height above the flat face of the flange being made up. This assures adequate squeeze on the metal seal when the flange is made up. If a mistake or problem occurs so that the seal leaks, loosen the flange studs, remove the head, adjust the tolerance eliminator nut to add or subtract squeeze and reinstall head by making up flange and test the integrity of the seal.

A further object is the provision of a metal well head seal for sealing between inner and outer concentric well head components which include a circular metal seal having a flat end and a tapered end and is positioned between the inner and outer components. A forcing cone is provided on one of the components engaging the tapered end for sealing between the inner and outer components. A backup shoulder engages the flat end and means are provided for moving the inner and outer well head components longitudinally together for setting the metal seal.

Further features of the present invention is wherein the angle of the tapered end is less than the angle of the forcing cone, wherein the seal outer circumference angles inwardly from the tapered end to the flat end, where the angle of the forcing cone is no greater than approximately 20° in most cases, and the thickness of the tapered end is at least 100 thousandths of an inch in most cases.

A further object is the provision of a metal seal for sealing between well casing and a tubing head of a well head in which the casing is supported by the starting head and the tubing head is attached to the starting head by threaded studs. The seal includes a circular seal positioned around the casing and the seal includes a flat bottom end and a tapered upper end. A forcing cone is provided on the tubing head for engaging the tapered end and setting the seal between the casing and the tubing head when the studs are tightened. Adjusting means are provided engaging the flat bottom and is seated on a starting head for adjusting the tolerances between the tapered end and the forcing cone.

Still a further object of the present invention is the provision of a casing retainer nut for preventing the casing from longitudinally expanding and breaking the integrity of the metal seal. The retainer nut is threadably connected to the inside of the tubing head above the casing metal seal and is positioned for engagement with the top of the casing.

Yet a further object of the present invention is the provision of a metal seal for sealing between a tubing hanger and tubing head of a well head. A circular metal seal is positioned around the tubing hanger and against the inside of the tubing head and the seal includes a flat bottom end and a tapered upper end. A forcing cone on the outside of the tubing hanger engages the tapered end for setting the seal between the tubing hanger and the tubing head. A junk ring is carried on the outside of the tubing hanger and engages the flat bottom of the seal. The tubing head includes a support shoulder on its inside for receiving the junk ring for supporting the tubing hanger and setting the seal as a tubing hanger moves downwardly relative to the tubing head.

Still a further object of the present invention is the provision of lock down screws in a well head such as in the tubing head engaging the tubing hanger for holding the tubing hanger in place, and metal seal means between the tubing head and the lock down screws. The metal seal includes a circular seal, a forcing cone such as on the lock down screws, and a movable backup shoulder.

Yet a still further object of the present invention is the provision of a metal seal for sealing between a tubing hanger and a tubing head adapter in a well head and includes a circular metal seal positioned around the tubing hanger and against the inside of the tubing head adapter. The seal includes upper first and second concentric seal rings having a flat top end and a tapered bottom end, and third and fourth lower concentric seal rings positioned below the first and second seal rings. The third and fourth seal rings have a flat bottom end and a tapered top end. A lantern ring having tapered upward and lower ends is positioned between the upper and lower rings. An adjusting means adjusting the distance between the flat top ends of the first and second rings and the flat bottom ends of the third and fourth rings are provided for adjusting the tolerances between the tapered ends and the lantern ring.

Other and further objects, features and advantages will be apparent from the following description of a presently preferred embodiment of the invention, given for the purpose of disclosure, and taken in conjunction with the accompanying drawings.

DESCRIPTION OF THE PREFERRED EMBODIMENT

While the present invention will be described, for purposes of illustration, as useful in a particular well head, it will be understood that the metal seal system herein described is useful in other types of well heads.

Figure 1A:
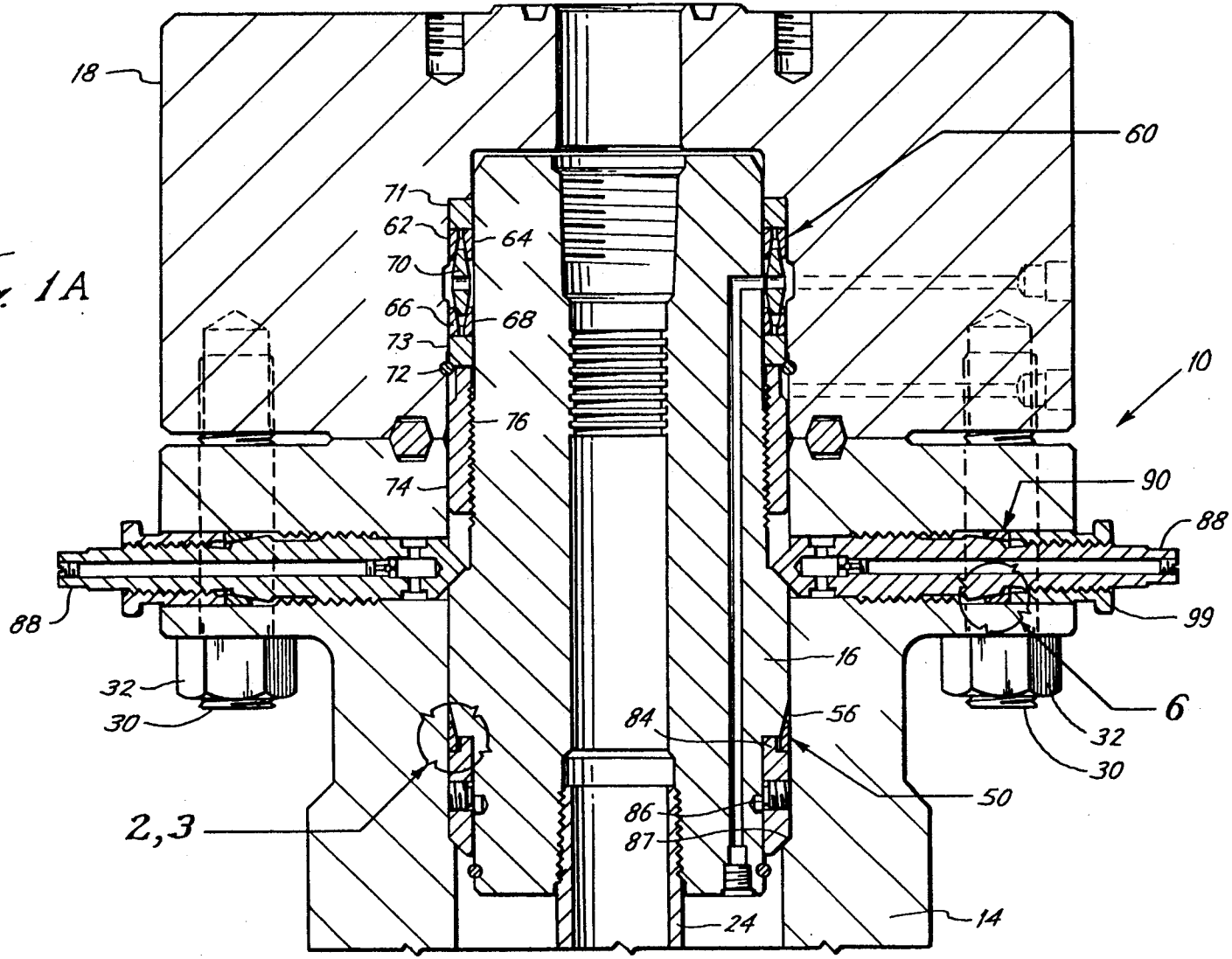
FIGS. 1A and 1B are continuations of each other and form a cross section of a well head utilizing various metal seal rings of the present invention.
Figure 1B:
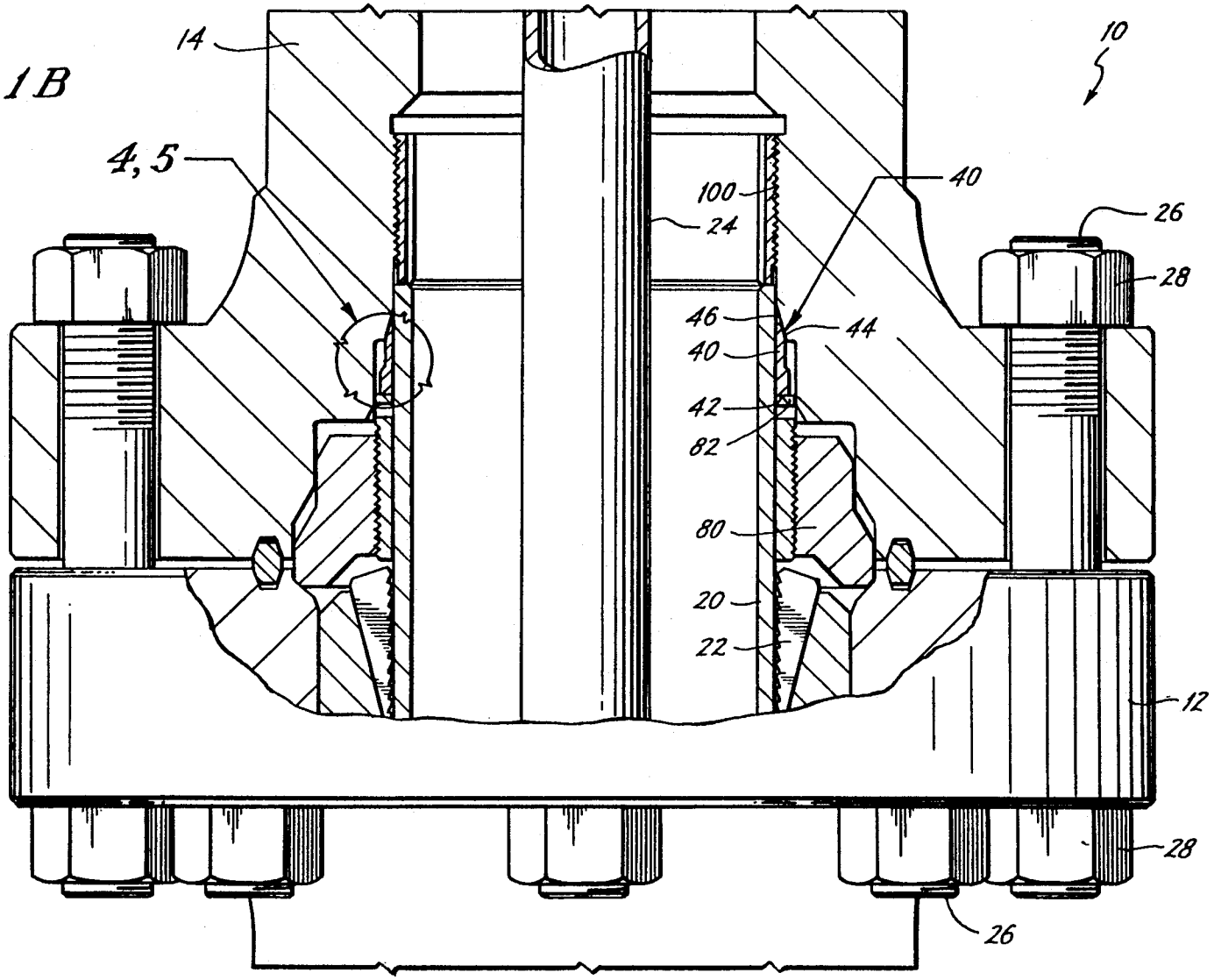

Referring now to the drawings, and particularly to FIGS. 1A and 1B, the reference 10 generally indicates the well head of the present invention and includes as is conventional a starting head 12, a head, such as a tubing head 14, a tubing hanger body 16 and a tubing hanger adapter 18. A casing 20 is supported from the starting head 12 by slip assembly 22. Tubing 24 is supported from the tubing hanger body 16. Threaded studs 26 and nuts 28 connect the starting head 12 to the tubing head 14. Threaded studs 30 and nuts 32 threadably connect the tubing head 14 and the tubing head adapter 18.

The above general description of the well head 10 is generally conventional. However, the present invention is directed to providing various metal seals in the well head 10 which avoids the use of elastomer seals and overcomes the problems mentioned above in connection with conventional metal seals. The present invention is directed to providing a metal seal 40 between the casing 20 and the head 14, a metal seal 50 between the tubing hanger body 16 and the tubing head 14, a metal seal generally indicated by the reference 60 between the tubing hanger body 16 and the tubing head adapter 18, and a metal seal 90 between the lock down screws and the tubing head.

Figure 4:
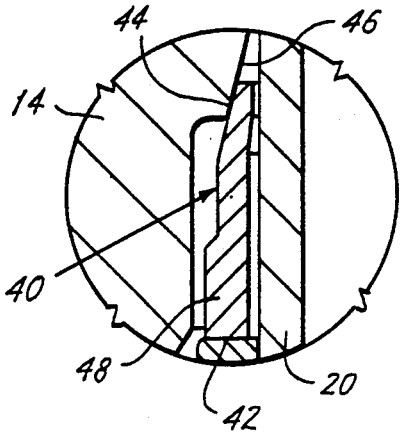
FIG. 4 is an enlarged view of the casing seal of FIG. 1B before setting.
Figure 5:
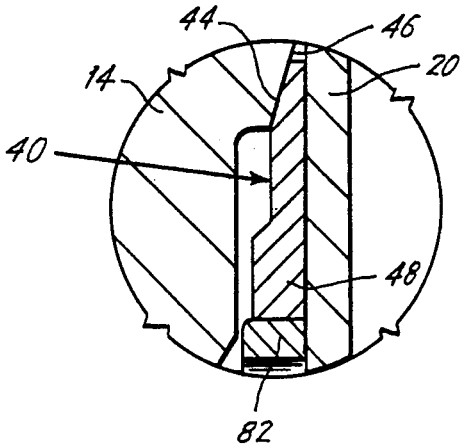
FIG. 5 is a view similar to FIG. 4 but in the set position.

Referring now to FIGS. 1B, 4 and 5, the metal seal 40 provides a circular metal seal positioned around the casing 20 for sealing between the casing 20 and the head 14. The seal 40 includes a flat bottom end 42 and a tapered upper end 44. A forcing cone 46 is provided on the inside of the head 14 for engaging the tapered end 44 and setting the seal 40 between the head 14 and the casing 20 when the studs 26 between the starting head 12 and the head 14 are tightened thereby pulling the cone 46 against the tapered end 44.

In order to adjust the tolerances between the cone surface 46 and the tapered end 44 of the seal 40 adjusting means are provided engaging the flat bottom end 42 of the seal 40. The adjusting means includes an adjusting nut having a first part 80 which seats on the starting head 12 and a second threadably connected sleeve part 82. By rotating the first part 80 relatively to the second part 82 a predetermined height may be obtained above the flat face of the flange of the starting head 12 to assure the proper squeeze on the tapered end 44. If a mistake or problem occurs so that the seal 40 leaks, the flange studs 26 are loosened, the tubing head 14 is removed, and the height of the second part 82 of the tolerance adjusting means is adjusted to add or subtract squeeze on the tapered end 44. The seal 40 seals in bidirectional operation, does not require a smooth surface or close tolerance on the casing OD, and a single seal 40 will cover a variety of tolerance variances and out of roundness of the casing OD. The seal 40 is protected until formed into a sealing shape as best seen in FIG. 5 when energized to hold high temperature and high and low pressure gas or liquid in two directions. When formed, the seal is in compression so that it coins and forms a seal at a predetermined place and also generates spring forces which keep it energized (an interference fit) if load is removed for any reason.

In order to make a good seal it is preferable that the angle of the cone 46 be mismatched with the angle of the tapered end 44. Preferably, the angle of the cone 46 is 15° and the angle of the tapered end 44 is 13°. In addition, the back surface or inner circumference 48 of the seal 40 angles outwardly from the tapered end 44 to the flat end 42, for example, 1°, in order to form a better seal at the tapered end 44.

However, in deep wells with high temperatures, it is common for the casing to expand longitudinally as the temperature goes up during production and to contract as the temperature goes down when the well is shut in. This expansion and contraction due to temperature changes can unseat the slips 22 and also break the integrity of the metal seal 40. The present invention also includes a casing retainer nut 100 for preventing the casing from expanding longitudinally and breaking the seal with seal 40 as well as unseating from the slips 22. The retainer nut 100 is threadably connected to the inside of the head 14, above the seal 40, and positioned for engagement with the top of the casing 20. In installing the retainer nut 100, nut 100 is rotated to the left to the up position, before the tubing head 14 is set down on top of the starting head 12. After the studs 26 and nuts 28 are made up, and the metal seal 40 is set, the nut 100 is rotated to the right to adjust it down on the top of the casing 20, as shown in FIG. 1B. This holds the top of the casing 20 between the nut 100 and the slips 22 in place. Normal right hand rotation of a drill pipe (not shown) while drilling does not loosen the nut 100, but tends to tighten the nut 100 on top of the casing 20.

Figure 2:
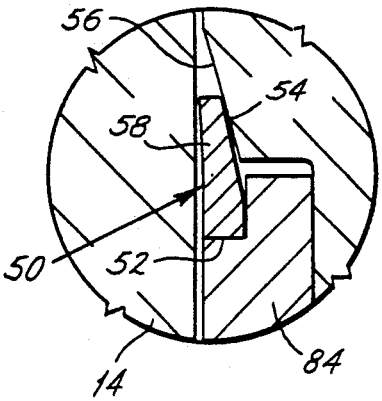
FIG. 2 is an enlarged view of a metal seal between the tubing hanger body and the tubing head of FIG. 1A before setting.
Figure 3:
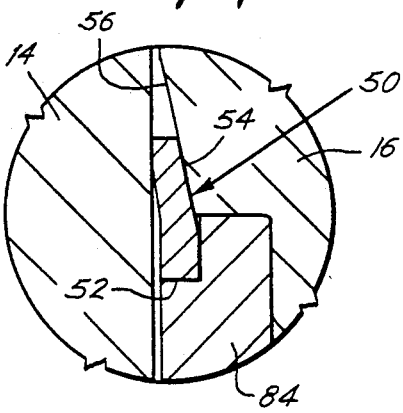
FIG. 3 is a view similar to FIG. 2 after setting.

Referring now to FIGS. 1A, 2 and 3, the structure of the metal seal 50 between the tubing hanger body 16 and the tubing head 14 is best seen. Again, the seal 50 is a circular metal seal positioned around the tubing hanger body 16 and against the inside of the tubing head 14 and the seal 50 includes a flat bottom end 52 and a tapered top end 54. A forcing cone 56 is formed on the outer circumference of the tubing hanger body for engaging the tapered end 54 and setting the seal between the tubing hanger 16 and the tubing head 14. A junk ring 84 is carried on the outside of the tubing hanger 16, initially by shear pins 86 for holding the seal 50 in place. After the tubing hanger body 16 is inserted in the tubing head 14 the junk ring 84 seats on a support shoulder 87 on the inside of the tubing head 14 thereby supporting the tubing hanger 16, tubing 24 and setting the metal seal 50. The tubing hanger body 16 is held in place in the tubing head 14 by lock down screws 88 and can be used to force the tubing hanger body 16 downwardly if the weight is insufficient to fully set the seals 50. Again, the angle of the forcing cone 56 is mismatched with the angle of the tapered 54 of the seal 50 and is generally several degrees larger, for example 15° for the cone 56 and 13° for the tapered 54. However, the angle of the cone 56 may be between 10° and 20° but is preferably no larger in order to provide a setting stroke for setting the seal 50. Also, the outside or outer circumference 58 of the seal 50 tapers inwardly from the tapered end 54 towards the flat end 52, for example 1° for providing a good seal at the tapered end 54.

Figure 6:
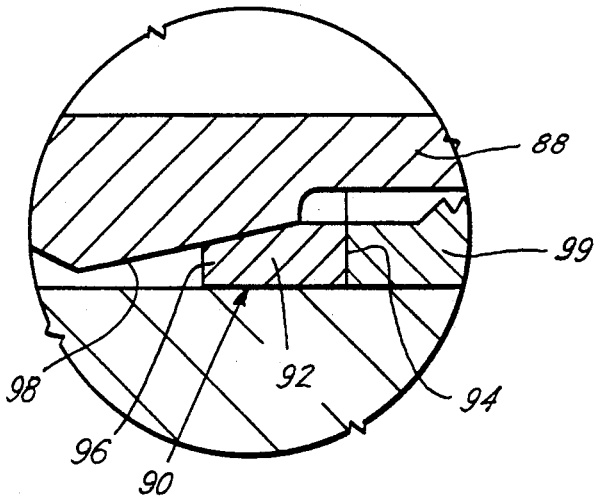
FIG. 6 is an enlarged view of the metal seal around the lock down screws.

Referring now to FIGS. 1A and 6, a metal seal 90 is provided between the lock down screws 88 and the tubing head 14, which with the remainder of the metal seals 40, 50, and 60 tends to make the well head 10 fire resistant. The seal 90 includes a circular metal seal 92 around each lock down screw 88. The seal 92 includes a flat end 94 and a tapered end 96. A circular forcing cone 98 is provided on each lock down screw 88 (although the cone could be formed on the tubing head 14) for engaging the tapered end 96 of the seal 92. A movable backup shoulder 99 threadably connected to each screw 88 engages the flat end 94 of each seal 92 for moving the seal 92 and cone 98 together. The angles and tapers of the cone 98 and seal 92 may be the same as seal 50, but the thickness of the tapered end 96 is approximately sixty thousandths of an inch. While the seal 90 has been shown as being on the lock down screws in the tubing head 14, such seals may be used on other lock down screws used in a well head.

Referring now to FIG. 1A, the metal seal 60 is for sealing between the tubing hanger 16 and the tubing head adapter 18 and includes a circular metal seal positioned around the tubing hanger 16 and against the inside of the tubing head adapter 18. The seal 60 includes a first 62 and second 64 upper concentric seal rings having a flat top end and a tapered bottom end, and third 66 and fourth 68 lower concentric seal rings positioned below the first and second seal ring 62 and 64. The third and fourth seal rings have a flat bottom end and a tapered upper end. The seal rings 62, 64, 66 and 68 are shaped generally the same as the metal seal ring 50 in FIGS. 2 and 3. A lantern ring 70 having tapered upper and lower ends is positioned between the upper ring 62 and 64 and the lower ring 66 and 68. Its tapered upper and lower ends coact with the tapered ends of the rings 62, 64, 66 and 68.

An upper junk ring 71 engages the flat top ends of the ring 62 and 64 and a lower junk ring 73 engages the flat ends of the third and fourth ring 66 and 68. Snap ring 72 is provided for holding the seal components of the seal 60 in place during installation. The seal 60 is set when the studs 30 and nuts 32 are tightened to connect the tubing head adapter to the tubing head body 14. In addition adjusting means are provided such as an adjusting nut 74 which is threadably connected by threads 76 to the exterior of the tubing hanger body 16. Again, the vertical height of the nut 74 can be adjusted to adjust the tolerances between the seal rings 62, 64, 66 and 68 and the lantern ring 70 for obtaining a proper seal. In addition, the shape, angles and size of the ring 62, 64, 66 and 68 are generally the same as the metal seal ring 50.

A prototype of the well head 10 has been tested at 350° F. and it was found that the seals 40, 50 and 60 would hold bidirectional gas at both 10,000 psi and 50 psi. The metal seal rings may be of any suitable metal and 304 stainless has been found to be satisfactory in many cases.

The seal rings require neither close tolerances nor fine finishes and by using the tolerance adjusters only one size seal is needed. The seal can be used more than one time if needed in the field and if there is a leak the seal can be adjusted to overcome the seal problems.

The present invention, therefore, is well adapted to carry out the objects and attain the ends and advantages mentioned as well as others inherent therein. While presently preferred embodiments of the invention have been given for the purpose of disclosure, numerous changes in the details of the construction and arrangement of parts will be readily apparent to those skilled in the art and which are encompassed within the spirit of the invention and the scope of the appended claims.

What is claimed is:

1. A metal well head seal for sealing between inner and outer concentric well head components comprising, a circular metal seal having a flat end and a tapered end, and positioned between the inner and outer components, a forcing cone on one of the components engaging the tapered end for forcing the tapered end against both components for sealing between the inner and outer components by the tapered end.

back up shoulder means engaging the flat end, means for moving the inner and outer concentric well head components longitudinally together for setting the metal seal, and adjusting means longitudinally movable relative to both components for adjusting the tolerance between the tapered end and the forcing cone.

2. A metal seal for sealing between a well casing and a head of a well head in which the casing is supported by a starting head and the head is attached to the starting head by threaded studs comprising, a circular metal seal positioned around the casing, said seal includes a flat bottom end and a tapered upper end, a forcing cone on the head for engaging the tapered end forcing the tapered end against both the casing and the head for and setting the seal between the casing and the head when the studs are tightened, movable adjusting means engaging the flat bottom and seated on the starting head for adjusting the tolerance between the tapered end and the forcing cone, and said adjusting means includes an adjusting nut having a first part seated on the starting head and a second sleeve part threadably connected to the first part, said second part surrounding the casing and engaging the flat bottom.

3. A metal seal for sealing between a well casing and a head of a well head in which the casing is supported by a starting head and the head is attached to the starting head by threaded studs comprising, a circular metal seal positioned around the casing, said seal includes a flat bottom end and a tapered upper end, a forcing cone on the head for engaging the tapered end forcing the tapered end against both the casing and the head for and setting the seal between the casing and the head when the studs are tightened, movable adjusting means engaging the flat bottom and seated on the starting head for adjusting the tolerance between the tapered end and the forcing cone, and a casing retainer nut threadably connected to the inside of the head and positioned for engagement with the top of the casing.

4. The seal of claim 3 wherein the casing retainer nut is positioned above the circular metal seal.

5. A metal seal for sealing between a tubing hanger and a tubing head adapter in a well head comprising, a circular metal seal positioned around the tubing hanger and against the inside of the tubing head adapter, said seal includes upper first and second concentric seal rings each having a flat top end and a tapered bottom end, third and fourth lower concentric seal rings positioned below the first and second seal rings, said third and fourth seal rings each having a flat bottom and a tapered top end, a lantern ring having tapered upper and lower ends and positioned between the upper and lower rings, adjusting means adjusting the distance between the flat top ends of the first and second rings and the flat bottom ends of the third and fourth rings for adjusting the tolerances between the tapered ends and the lantern ring.

* * * * *